US011920428B2

(12) United States Patent
Fu

(10) Patent No.: US 11,920,428 B2
(45) Date of Patent: Mar. 5, 2024

(54) SYSTEMS FOR INTER-FRACTURE FLOODING OF WELLBORES AND METHODS OF USING THE SAME

(71) Applicant: Xuebing Fu, Houston, TX (US)

(72) Inventor: Xuebing Fu, Houston, TX (US)

( * ) Notice: Subject to any disclaimer, the term of this patent is extended or adjusted under 35 U.S.C. 154(b) by 0 days.

(21) Appl. No.: 17/219,222

(22) Filed: Mar. 31, 2021

(65) Prior Publication Data

US 2021/0301622 A1 Sep. 30, 2021

Related U.S. Application Data

(60) Provisional application No. 63/002,569, filed on Mar. 31, 2020.

(51) Int. Cl.

| | |
|---|---|
| ***E21B 34/08*** | (2006.01) |
| ***E21B 33/12*** | (2006.01) |
| ***E21B 34/10*** | (2006.01) |
| ***E21B 41/00*** | (2006.01) |
| ***E21B 43/30*** | (2006.01) |

(52) U.S. Cl.

CPC ..... *E21B 34/08* (2013.01); *E21B 33/12* (2013.01); *E21B 34/10* (2013.01); *E21B 41/0035* (2013.01); *E21B 43/305* (2013.01)

(58) Field of Classification Search

CPC ..... E21B 34/08; E21B 33/12; E21B 34/10; E21B 43/305

See application file for complete search history.

(56) References Cited

U.S. PATENT DOCUMENTS

| | | | | |
|---|---|---|---|---|
| 8,408,314 | B2 * | 4/2013 | Patel | E21B 37/06 166/373 |
| 8,657,015 | B2 * | 2/2014 | Patel | E21B 34/08 166/325 |
| 9,127,544 | B2 | 9/2015 | Dombrowski et al. | |
| 9,562,422 | B2 | 2/2017 | Sharma et al. | |
| 9,581,003 | B2 * | 2/2017 | Kofoed | E21B 33/12 |
| 10,208,547 | B2 | 2/2019 | Kjorholt et al. | |

(Continued)

FOREIGN PATENT DOCUMENTS

CN 110295879 10/2019

OTHER PUBLICATIONS

International Search Report and Written Opinion issued in Corresponding PCT Application No. PCT/US2021/070344, dated Aug. 16, 2021.

*Primary Examiner* — Catherine Loikith
(74) *Attorney, Agent, or Firm* — Norton Rose Fulbright US LLP

(57) ABSTRACT

Some systems and methods include a tubular defining a passageway, one or more packers coupled to the tubular, and two or more valves coupled to the tubular. Some such systems are operable by increasing pressure within the passageway such that, responsive to the increasing pressure, one or more first ones of the valves open and fluid flows from the passageway, through the first valve(s), and into one or more first fractures of the wellbore, and reducing pressure within the passageway such that, responsive to the reducing pressure, the first valve(s) close and one or more second ones of the valves open and hydrocarbons flow from one or more second fractures of the wellbore, through the second valve(s), and into the passageway. The first and second valves can be unidirectional valves.

19 Claims, 5 Drawing Sheets

(56) References Cited

U.S. PATENT DOCUMENTS

| | | | |
|---|---|---|---|
| 2013/0228337 | A1 | 9/2013 | Dombrowski et al. |
| 2014/0318781 | A1 | 10/2014 | Kofoed et al. |
| 2015/0192001 | A1 | 7/2015 | Hall |
| 2015/0369023 | A1 | 12/2015 | MacPhail et al. |
| 2017/0030173 | A1 | 2/2017 | MacPhail et al. |
| 2018/0003017 | A1 | 1/2018 | Whitson |

* cited by examiner

SYSTEMS FOR INTER-FRACTURE FLOODING OF WELLBORES AND METHODS OF USING THE SAME

CROSS-REFERENCE TO RELATED APPLICATION

This application claims priority to U.S. Provisional Patent Application No. 63/002,569, filed Mar. 31, 2020, which is incorporated herein by reference in its entirety.

FIELD OF INVENTION

The present invention relates generally to systems for hydrocarbon production, and more specifically but without limitation, to systems for inter-fracture flooding of wellbores and methods of using the same.

BACKGROUND

Oil production from tight formations became particularly significant over the last decade, with advances in horizontal drilling and multi-stage hydraulic fracturing. Despite such advances, however, primary recovery from tight formations remains low—in some instances, 90% or more of the formation's oil is left in place.

To address this, post-primary recovery methods are sometimes used, but these methods typically have limited success. One such method is flooding between wells, in which a fluid (e.g., water and/or gas) is injected into a wellbore that is near the producing wellbore, in hopes that the fluid will "sweep" oil from the formation into the producing wellbore where it can then be recovered. Often, however, the tight nature of the formation limits the fluid's ability to enter the formation from the injecting wellbore, or the fluid short-circuits to the producing wellbore (e.g., via fractures), leaving the formation unswept. Another post-primary recovery method is refracturing, in which new fractures are generated in the wellbore to increase access to the formation. But if the designated portion of the formation is already pressure-depleted through the original fractures, such new fractures will usually not substantially increase oil recovery. Cyclic gas injection, or "huff-and-puff," is another post-primary recovery method, which involves: (1) injecting gas into the wellbore to pressurize the formation's oil and reduce its viscosity ("huff"); and (2) producing the energized fluid ("puff") through the wellbore. While huff-and-puff has had some success, results are inconsistent, it requires a large amount of gas, and its usage of the same is relatively inefficient.

Fracture-to-fracture flooding within a single wellbore has also been proposed as a post-primary recovery method, whether through simultaneous fluid injection into certain fractures and production from others, or fluid injection into certain fractures followed sequentially by production from others. Both options have shown positive results in simulations; an intra-wellbore fracture-to-fracture flooding pattern, particularly using an oil-miscible gas, might lead to substantial hydrocarbon recovery. In practice, however, both require complex downhole tool systems and/or complex operations. For simultaneous injection and flooding, a dual-tubing system is needed, with a tubular to connect injection zones in the wellbore and a tubular to connect production zones in the wellbore, ensuring isolation between the injection and production zones. And for sequential injection and flooding, while a single tubular can be used, it needs to be opened and closed at each of the injection and production zones to ensure such isolation. Due, in part, to the currently available down hole systems not readily meeting this tool-system requirement, neither simultaneous nor sequential intra-wellbore injection and production has had meaningful success.

SUMMARY

There accordingly is a need in the art for a simple system through which an intra-wellbore fracture-to-fracture flooding pattern can be conducted. The present systems and methods address this need by providing for such a process that is self-regulating; for example, performed by managing the wellhead pressure at the surface or changing the well's operating mode between injection and production. In some embodiments, this is achieved by disposing a tubular into a lateral, isolating zones along the lateral, and associating pressure-responsive valves with those zones, where ones of the valves associated with injection zones open in response to higher pressure within the tubular than outside of the tubular, and ones of the valves associated with production zones open in response to lower pressure within the tubular than outside the tubular (e.g., during production).

The term "intra-wellbore fracture-to-fracture flooding" is interchangeable with "inter-fracture flooding," and the term "cyclic injection" is interchangeable with "huff-and-puff" Further, an inter-fracture flooding process conducted in a sequential manner can also be referred to as an "inter-fracture huff-and-puff" process.

Some embodiments of the present systems for inter-fracture flooding of a wellbore comprise: a tubular defining a passageway, one or more packers coupled to the tubular, and two or more unidirectional valves coupled to the tubular, the unidirectional valves including one or more first unidirectional valves, each configured to open to permit fluid communication from the passageway to outside of the tubular through the first unidirectional valve, and close to prevent fluid communication from outside of the tubular to the passageway through the first unidirectional valve, and one or more second unidirectional valves, each configured to open to permit fluid communication from outside of the tubular to the passageway through the second unidirectional valve, and close to prevent fluid communication from the passageway to outside of the tubular through the second unidirectional valve, wherein, for each of the second unidirectional valve(s), at least one of the packer(s) is disposed between the second unidirectional valve and each adjacent one of the first unidirectional valve(s) along the tubular.

In some systems, at least one of the first and second unidirectional valves is configured to open in response to a pressure differential between the passageway and outside of the tubular that acts on the unidirectional valve. In some systems, at least one of the first and second unidirectional valves is a check valve.

In some systems, at least one of the first unidirectional valve(s) is biased closed. In some systems, at least one of the first unidirectional valve(s) is configured to open when pressure in the passageway acting on the first unidirectional valve is at least 1 pound per square inch (psi) higher than pressure outside of the tubular acting on the first unidirectional valve. In some systems, at least one of the second unidirectional valve(s) is biased closed. In some systems, at least one of the second unidirectional valve(s) is configured to open when pressure outside of the tubular acting on the second unidirectional valve is at least 1 psi higher than pressure in the passageway acting on the second unidirectional valve.

In some systems, the packer(s) comprise two or more packers, and at least two of the packers are disposed between adjacent ones of the first and second unidirectional valves along the tubular. In some systems, the packer(s) comprise two or more packers, wherein the first unidirectional valve(s) comprise two or more first unidirectional valves, and at least two of the first unidirectional valves are disposed between adjacent ones of the packers along the tubular, or the second unidirectional valve(s) comprise two or more second unidirectional valves, and at least two of the second unidirectional valves are disposed between adjacent ones of the packers along the tubular.

Some of the present methods for inter-fracture flooding of a wellbore comprise: disposing a tubular having a passageway into the wellbore, the tubular coupled to one or more first valves and one or more second valves, increasing pressure within the passageway such that, responsive to the increasing pressure, the first valve(s) open and fluid flows from the passageway, through the first valve(s), and into one or more first fractures of the wellbore, and reducing pressure within the passageway such that, responsive to the reducing pressure, the first valve(s) close, the second valve(s) open, and hydrocarbons flow from one or more second fractures of the wellbore, through the second valve(s), and into the passageway.

In some methods, increasing pressure within the passageway is performed at least by pumping fluid into the passageway. In some methods, the pumped fluid comprises a majority, by volume and/or mass, of a gas.

In some methods, at least one of the first and second valves is a unidirectional valve. In some methods, at least one of the first and second valves is a check valve. In some methods, at least one of the first valve(s) is biased closed. In some methods, at least one of the second valve(s) is biased closed.

In some methods, one or more packers are coupled to the tubular, and, for each of the second valve(s), at least one of the packer(s) is disposed between the second valve and each adjacent one of the first valve(s) along the tubular. In some methods, the packer(s) comprise two or more packers, and at least two of the packers are disposed between adjacent ones of the first and second valves along the tubular.

In some methods, a formation into which the wellbore extends has an average permeability that is less than approximately 0.5 millidarcies (mD), optionally, less than approximately 0.1 mD. In some methods, the wellbore is cased.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified—and includes what is specified; e.g., substantially 90 degrees includes 90 degrees and substantially parallel includes parallel—as understood by a person of ordinary skill in the art. In any disclosed embodiment, the terms "substantially" and "approximately" may each be substituted with "within [a percentage] of" what is specified, where the percentage includes 0.1, 1, 5, and 10 percent.

The phrase "and/or" means and or or. To illustrate, A, B, and/or C includes: A alone, B alone, C alone, a combination of A and B, a combination of A and C, a combination of B and C, or a combination of A, B, and C. In other words, "and/or" operates as an inclusive or. Unless specified otherwise, the term "or," as used herein, refers to an inclusive or and is interchangeable with the term "and/or."

The terms "comprise" and any form thereof such as "comprises" and "comprising," "have" and any form thereof such as "has" and "having," and "include" and any form thereof such as "includes" and "including" are open-ended linking verbs. As a result, an apparatus that "comprises," "has," or "includes" one or more elements possesses those one or more elements but is not limited to possessing only those one or more elements. Likewise, a method that "comprises," "has," or "includes" one or more steps possesses those one or more steps but is not limited to possessing only those one or more steps.

Any embodiment of any of the apparatuses, systems, and methods can consist of or consist essentially of—rather than comprise/have/include—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Further, an apparatus, system, or method that is configured in a certain way is configured in at least that way, but it can also be configured in other ways than those specifically described.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION

Figure 1:
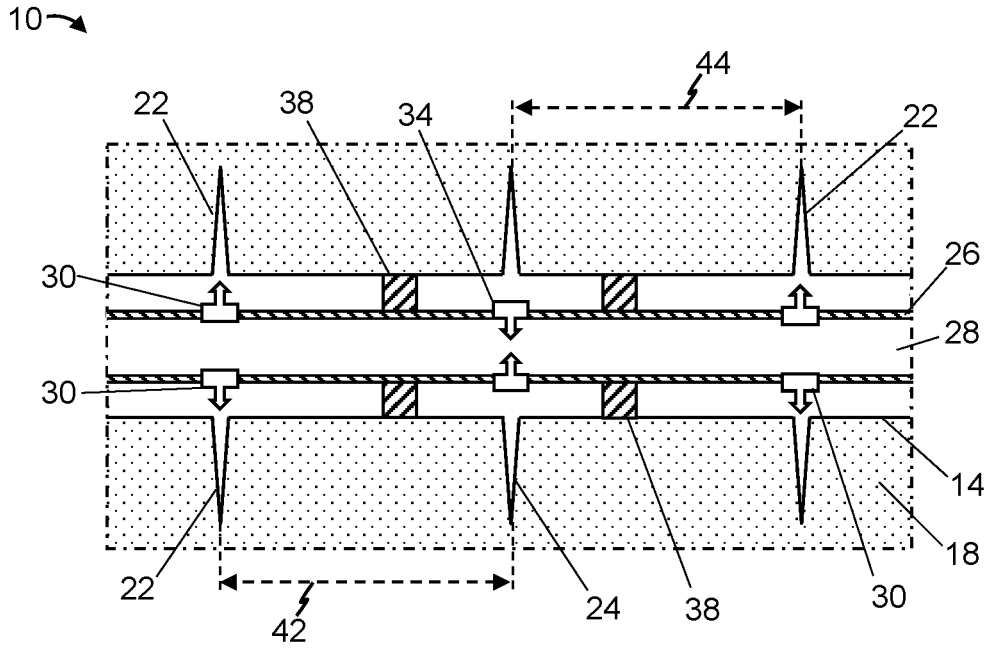
FIG. 1 is a schematic of an example of one of the present system installed in a wellbore.

Referring to FIG. 1, shown is an embodiment 10 of the present system that is illustrated in a wellbore 14 that is drilled into a formation 18 having fractures (e.g., 22) in fluid communication with a portion of the formation. System 10 includes a tubular 26 that defines a passageway 28 and a plurality of valves (e.g., 30, 34) coupled to the tubular, each of the valves configured to selectively permit fluid communication with the passageway. In some embodiments, one or more first valves 30 coupled to tubular 26 may permit fluid communication from passageway 28 to formation 18, and one or more second valves 34 coupled to the tubular may permit fluid communication from the formation to the passageway. As shown in FIG. 1, one or more packers 38 may be coupled to tubular 26 to isolate a portion(s) of wellbore 14. For example, packers 38 can be disposed on opposing sides of second valve 34, thereby isolating a portion of formation 18 (e.g., near fractures 24) from other portions of the formation (e.g., near fractures 22).

The first and second valves 30, 34 may be positioned adjacent to, or aligned with, a fracture (e.g., 22, 24) or a group of fractures to enable fluid communication between passageway 28 and formation 18. In some embodiments, tubular 26 is positioned within wellbore 14 such that first valves 30 are positioned adjacent to first fractures 22 and second valves 34 are positioned adjacent to second fractures 24. First valves 30 and second valves 34 need not be positioned directly adjacent to first and second fractures, respectively, but may be positioned within zones corresponding to the first and second fractures, respectively (e.g., injection and production zones) that can defined and isolated by packers 38. In this way and others, system 10 may utilize certain fractures (e.g., first fractures 22) for injection and utilize other fractures (e.g., second fractures 24) for production. To illustrate, fluid flowing from passageway 28 into formation 18 flows from the passageway, through first valves 30, and into first fractures 22 of wellbore 14 and fluid flowing from the formation to the passageway flows from second fractures 24 of the wellbore, through second valves 34, and into the passageway.

Thus, unlike conventional huff-and-puff where the injection and production are conducted at the same fracture locations, system 10 allows for injecting fluids preferentially into certain fractures—those in injection zones—and producing fluids preferentially from others—those in production zones—to promote flooding in which fluid injected to injection zones will "sweep" oil from formation 18 into producing zones where it can be recovered. Some embodiments of system 10 enhance such flooding by isolating these injection and production zones from one another (e.g., via packers 38).

Each of the first and second valves 30, 34 may be a unidirectional valve such as, for example, a check valve (e.g., nozzle check valve, ball check valve, diaphragm check valve, swing check valve, stop-check valve, etc.), non-return valve, reflux valve, retention valve, foot valve, one-way valve, or the like. For example, first valves 30 are configured to open to permit fluid communication from passageway 28 to outside of tubular 26 (e.g., an annulus of wellbore 14) (e.g., to first fracture 22) through the first valves and close to prevent fluid communication from outside of the tubular to the passageway through the first valves. In contrast, second valves 34 are configured to open to permit fluid communication from outside of tubular 26 (e.g., from second fractures 24) to passageway 28 through the second valves and close to prevent fluid communication from the passageway to outside of the tubular through the second valves. As shown in FIG. 1, system 10 include two first valves and one second valve 34 in the depicted section of wellbore 14; however, any number of first or second valves may be employed (e.g., between one and one hundred valves) in a particular section of the wellbore. A larger number of valves may reduce the likelihood of the valves running at their limits and decrease risk of failure and a lower number of valves may reduce cost and complexity of the system.

In some embodiments, each of the first and second valves 30, 34 is a passive valve such that each valve (e.g., 30, 34) is configured to open in response to a pressure within passageway 28 that acts on the valve, a pressure outside of tubular 26 that acts on the valve, or a pressure differential between those two pressures. In at least this way, the valves are self-regulating. For example, operation of the valves can be achieved through managing the wellhead pressure at the surface or changing the operating mode between injection and production. Passive valves can provide simplicity and reduce costs.

In some embodiments, such passive valves are mechanical as opposed to electronically-controlled, which can provide the additional advantage of increased reliability. To illustrate, electrical flow regulators require components (mechanical and electronic) that may be damaged due to shocks and vibrations that are common in drilling, injection, and production processes. Nevertheless, such passive valves may be electronically-controlled. For example, such a valve can be associated with one or more sensors configured to capture data indicative of pressure within passageway 28 that acts on the valve and/or a pressure outside of tubular 26 that acts on the valve, and the valve can be configured to open or close based on one or both of these pressures or the difference between them.

In some embodiments, valves 30, 34 may be biased toward an open position—permitting fluid communication—or, alternatively, a closed position—preventing fluid communication. In some embodiments in which first valve 30 is biased toward the closed position, a pressure within passageway 28 must be greater than a pressure outside of tubular 26 at the first valve for it to open. Similarly, in some embodiments in which second valve 34 is biased toward the closed position, a pressure outside of tubular 26 must be greater than a pressure within passageway 28 at the second valve for it to open.

First valve 30 may be biased via a biasing member (e.g., spring, swing, magnetic, elastic, or other biasing member) to prevent opening of the first valve unless the differential between passageway 28 and outside of tubular 26 is greater than or equal to a cracking pressure. As an illustrative example, at least one of (up to and including all of) first valves 30 is configured to open when pressure in passageway 28 acting on the first valve is greater than or equal to any one of, or between any two of: 1, 2, 5, 8, and 10 percent (%), or greater than or equal to any one of, or between any two of: 0.1, 0.2, 0.3, 0.4, 0.5, 1.0, 1.5, 2.0, 2.5, 3.0, 4.0, 4.5, 5.0, 6.0, 6.5, 7.0, 8.0, 9.0, 10.0, 20.0, 50.0, 75.0, 100.0, 150.0, 200.0, 300.0, 400.0, 500.0, 750.0, or 1000.0 psi, higher than pressure outside of tubular 26 acting on the first valve. Additionally, or alternatively, one or more second valves 34 may be biased similarly to that described above for first valves 30, except that such a second valve is configured to open when pressure outside of tubular 26 acting on the second valve is greater than pressure in passageway 28 acting on the second valve.

In some embodiments, at least one of first valves 30 can be configured to open at a pressure differential (e.g., cracking pressure) that is different than an opening pressure differential of at least one other of the first valves. For example, in a long wellbore 14, the frictional pressure drop across tubular 26 may be substantial, particularly when the fluid injection rates or production rates are high. Accordingly, one or more first valves (e.g., 30) near a toe of the well may have a lower cracking pressure than one or more first valves near a heel of the well. In at least this way, the higher cracking pressure for valves near the heel can at least partially account for a higher injection pressure at the heel and thereby suppress preferential flow of the injection fluid into zones near the heel over those near the toe. Additionally, or alternatively, different cracking pressures can be applied to the plurality of second valves 34 positioned within one zone or different zones along tubular 26. Such variable biasing may promote a more even distribution of fluid injection into and/or production from different reservoir sections along wellbore 14.

One or more additional components may be coupled to, or included with, the valves 30, 34. For example, an orifice may be coupled to an inlet of a valve to limit the rate of fluid flow through the valve in certain zones of preferential flow, which can mitigate problems such as thief zones or direct communication between injection and production fractures. As another example, a sand control device may be coupled to an inlet of a valve to reduce the risk of the valve clogging. As a further example, an AICD, or autonomous inflow control device, may be coupled to a valve to preferentially flow liquid or gas through the valve. And as yet another example, a re-closable sleeve may be coupled to a valve to shut in flow through the valve completely when desired; the re-closable sleeve may have a different operating mechanism, e.g. opened or closed mechanically by a coil tubing unit or controlled electrically, than the valve to which it is coupled.

Referring again to FIG. 1, packers 38 are coupled to tubular at locations to isolate certain fractures (e.g., 24). For example, system 10 can include two or more packers 38 that are disposed on opposing sides of one or more second fractures 24, thereby isolating the second fracture(s) from one or more first fractures 22. The locations where the packers 38 are set may depend largely on the fracture locations along wellbore 14 and the properties of the fractures (e.g., 22, 24). If the fractures are distinctive fractures along wellbore 14, at reasonable spacing, then packers 38 may be set to isolate individual fractures (e.g. Pinpoint Fracturing). Alternatively, if the fractures are tightly spaced or do not have clear spacing, packers 38 may be set to isolate groups of fractures.

Figure 2:
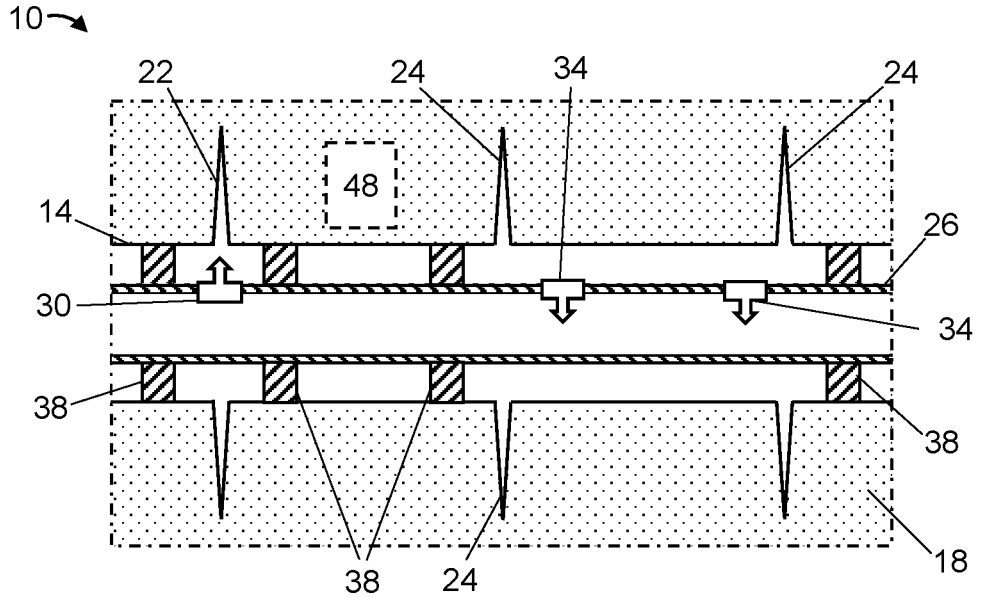
FIG. 2 is a schematic of another example of one of the present system installed in a wellbore.

Referring now to FIG. 2, shown is another illustrative portion of wellbore 14 defined in formation 18 in which system 10 may be deployed. Provided by way of illustration, formation 18 may include an injection zone (e.g., portion of wellbore 14 including first fractures 22 or associated with first valves 30), a production zone (e.g., portion of wellbore 14 including second fractures 22 or associated with second valves 34), and a dead zone 48. Dead zone 48 may correspond to a non-productive or problematic zone, such as an aquifer or other groundwater zone. Though not depicted in FIG. 2, dead zone 48 may also have one or more fractures associated with it. As shown, each zone may be isolated from at least one other zone of the wellbore via packers 38 disposed on opposing sides of the zone. For example, packers 38 are set such the injection zone, production zone, and dead zone 48 are not in fluid communication with one another within the wellbore. In some embodiments, packers 38 define the boundaries of the zones of wellbore 14. Although shown as having on a single injection zone, production zone, and dead zone 48, wellbore 14 may include any number of respective zones.

First valves 30 and second valves 34 may be coupled to tubular 26 such that the first valves are disposed at injection zones and in fluid communication with first fractures 22 while the second valves are disposed at production zones and in fluid communication with second fractures 24. In some embodiments, more than one first valve 30 or more than one second valve 34 is disposed between adjacent packers 38 (e.g., within a zone). For example, as shown in FIG. 2, two second valves 34 are disposed between adjacent ones of packers 38 along tubular 26. In other embodiments, a single second valve (e.g., 34) or more than two second valves (e.g., 3, 4, 5, 6, 7, 8, 9, 10, 11, 12, or more second valves) are disposed between adjacent packers 38. Additionally, or alternatively, one or more first valves 30 (e.g., 1, 2, 3, 4, 5, 6, 7, 8, 9, 10, 11, 12 or more first valves) can be disposed between adjacent packers 38 along tubular 26. In some embodiments, such as those with high formation permeability, first valves 30 and second valves 34 may be disposed in formation 18 at locations without fractures. In such embodiments, first and second valves 30, 34 may have sufficient fluid communication with formation 18 without needing fractures.

In some embodiments, valves may be omitted from sections of tubular 26 that are associated with or disposed within dead zone 48. As shown in FIG. 2, a portion of tubular 26 disposed between a pair of adjacent packers 38 (e.g., dead zone 48) does not include valves. In this way, multiple (e.g., two or more) packers 38 may be disposed between adjacent ones of first and second valves 30, 34 along tubular 26. Such embodiments may improve isolation between zones within formation 18.

Although FIGS. 1 and 2 illustrate wellbore portions with one or two first fractures 22 or second fractures 24, in other embodiments, other numbers of first or second fractures—1, 2, 4, 5, 6, 7, 8, 9, 10, or more—are also suitable. Fractures 22, 24 can be created via hydraulic fracturing, in which a fracturing fluid (e.g., comprising water, a friction-reducer, a polymer, a cross-linker, a gel, a foam, an oil-based fluid, a surfactant, and/or the like) is injected into wellbore 14 at a high enough pressure to fracture formation 18. A proppant, such as sand, ceramic particles, and/or the like, can then be pumped into fractures 22, 24 to keep them open and thereby provide flow paths between wellbore 14 and formation 18 for injection and production. First and second fractures 22, 24 are depicted as biwing planar fractures, but more complex fractures are also suitable, such as those that extend into formation 18 in multiple directions to form a three-dimensional fracture network.

First fractures 22 or second fractures 24 can be pre-existing, created in wellbore 14 as part of the present methods, or combination thereof. To illustrate, some of the present methods encompass creating one or more additional first or second fractures 22, 24 in a pre-existing wellbore portion having one or more pre-existing first or second fractures, enhancing (e.g., via refracturing) one or more of the pre-existing fracture(s), drilling the wellbore portion (e.g., from a pre-existing vertical wellbore, by extending a pre-existing lateral of a wellbore, or the like) and subsequently creating the fractures, and/or the like.

A distance 42 (labeled in FIG. 1) between adjacent ones of a first fracture (e.g., 22) and a second fracture (e.g., 24), measured along wellbore 14, can be greater than or equal to any one of, or between any two of: 10, 15, 20, 25, 30, 35, 40, 45, 50, 60, 70, 80, 90, 100, 125, 150, 175, 200, 225, 250, 275, 300, 350, 400, 450, 500, 550, 600, 650, 700, 750, 800, 850, 900, 950, 1,000, 1,100, 1,200, 1,300, 1,400, 1,500, 1,600, 1,700, 1,800, 1,900, or 2,000 ft., with illustrative distances including 30, 45, 60, 90, 120, 150, 200, 300, 400, 500, 600, 800, 1,000, 1,500, and 2,000 ft. Distance 42 can, but need not, be substantially the same for different pairs of adjacent first and second fractures 22, 24. To illustrate, distance 42 between one of the first fractures 22 and a second fracture 24 may be the same as, or different from, a distance 44 between one other of the first fractures 22 and the second fracture. In some wellbores, first and second fractures 22, 24 may be disposed in clusters; for such wellbores, distances (e.g., 42, 44) are measured between adjacent ones of the clusters. When first fractures 22 or second fractures 24 are created as part of the present methods, distances (e.g., 42, 44) between adjacent ones of the first and second fractures can be selected to enhance hydrocarbon recovery from formation 18.

Figure 3A:
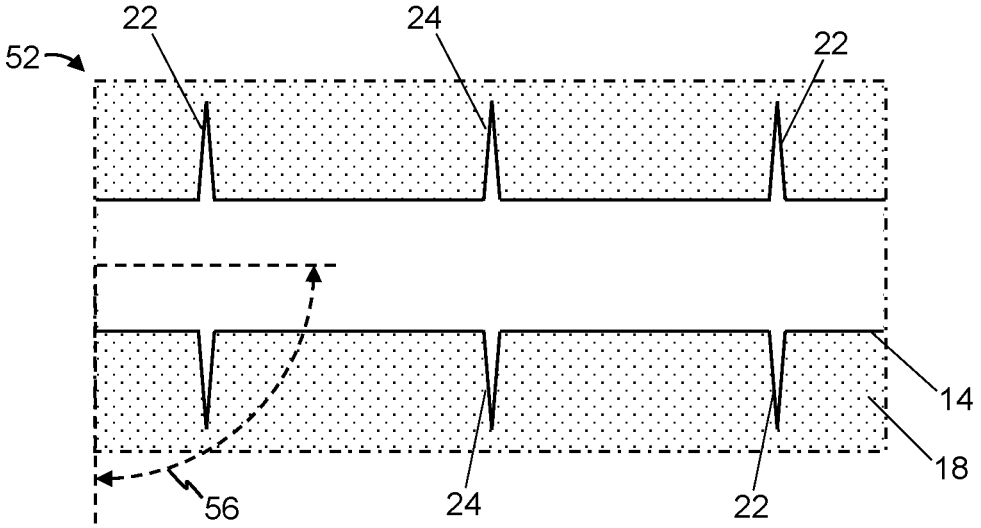
FIG. 3A is a schematic of a wellbore having first and second fractures in fluid communication with a formation.
Figure 3B:
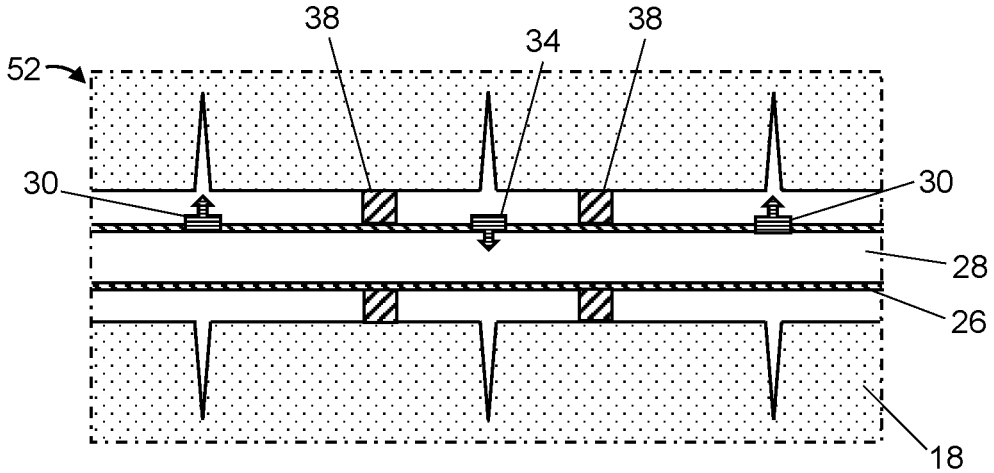
FIG. 3B is a schematic of the wellbore of FIG. 3A, shown after insertion of an example of a tubular of the present systems.

Referring to FIGS. 3A-3D, a method of operating system 10 (e.g., for inter-fracture flooding) is shown. As shown in FIGS. 3A and 3B, tubular 26 may be inserted within a portion 52 wellbore 14 to convey fluid (e.g., liquid, gas, or a combination thereof) into and out of the wellbore. As depicted, wellbore 14 is a horizontal wellbore. To illustrate, wellbore portion 52 can have an inclination angle 56 that is at least 80 or 85 degrees, can be a "lateral" as that term is understood in the art, and/or the like. The length of wellbore portion 52 can be, for example, greater than or equal to any one of, or between any two of: 100, 200, 500, 1,000, 2,000, 3,000, 5,000, 7,500, 10,000, 15,000, 20,000, or 30,000 ft. Wellbore portion 52 can be drilled along a direction of minimum horizontal stress in formation 18 (e.g., within 45, 40, 35, 30, 25, 20, 15, or 10 degrees of that direction), which encourages the fractures to propagate orthogonally to the wellbore portion. In some cases, however, other considerations may weigh against drilling wellbore portion 52 in the direction of minimum horizontal stress.

Wellbore portion 52 includes one or more first fractures 22 and one or more second fractures 24. Wellbore portion 52 is merely illustrative and the wellbore portion and one or more of its fractures 22, 24 can be formed in any manner as described herein or that is common in the art. For example, as shown, wellbore portion 52 is open-hole, having no casing or liner at the wellbore-formation interface, however, in other embodiments a wellbore portion (e.g., 52), or at least a section thereof, can be cased or lined. As another example, formation 18 can have an average permeability that is less than approximately 5.0 mD, such as an average permeability that is less than or equal to any one of, or between any two of: 5.0, 4.5, 4.0, 3.5, 3.0, 2.5, 2.0, 1.5, 1.0, 0.9, 0.8, 0.7, 0.6, 0.5, 0.4, 0.3, 0.2, 0.1, 0.75, 0.50, 0.25, 0.10, 0.075, 0.05, 0.025, 0.01, 0.0075, 0.005, 0.0025, 0.001, 0.00075, 0.0005, 0.00025, 0.0001, 0.000075, 0.00005, or 0.000025 mD. The present system 10 may be particularly effective on tight formations where hydrocarbon recovery from primary and traditional post-primary recovery methods was or would be low, such as formations having an average permeability that is less than 0.1, 0.01, 0.001, or 0.0005 mD.

Figure 3C:
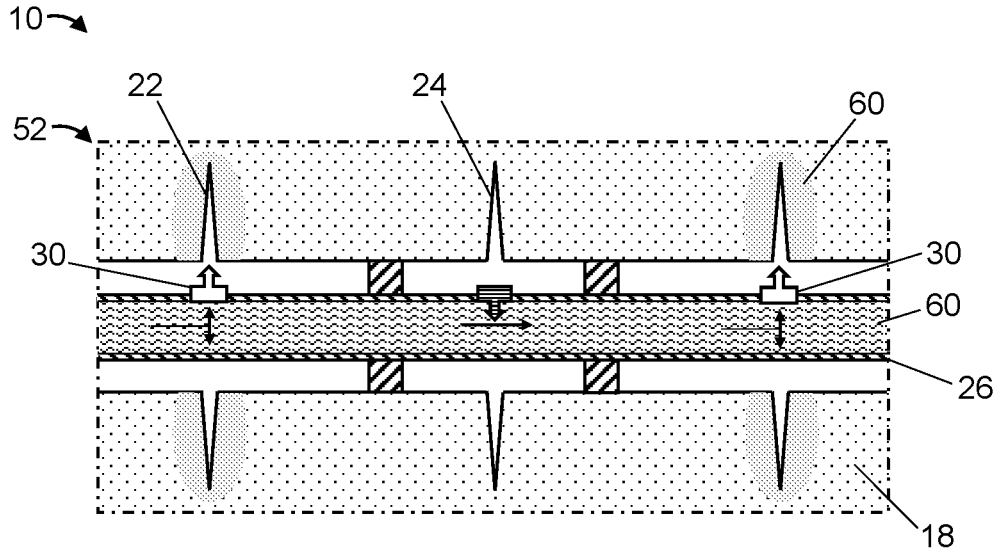
FIG. 3C is a schematic of the wellbore of FIG. 3A, shown during an injection process.

Turning now to FIG. 3C, fluid 60 may be pumped into wellbore portion 52 via passageway 28. As fluid 60 is pumped into passageway 28, pressure within the passageway increases until the pressure within the passageway acting against a first valve 30 is greater that a pressure outside tubular 26 (e.g., reservoir pressure) acting against the first valve, at which point the first valve opens to permit the fluid to flow into formation 18 via first fracture 22. In this way, first valves 30 are responsive to the pressure differential in wellbore 14. By increasing pressure within passageway 28, first valves 30 open and fluid 60 flows from passageway 28, through the first valves, and into first fractures 22. In some embodiments in which a first valve 30 is biased, the pressure within the passageway acting against the first valve must be greater than a pressure outside of tubular 26 acting against the first valve by a selected cracking pressure in order for the first valve to open.

As shown, while at least some of first valves 30 are open, second valves 34 remain closed. Accordingly, fluid 60 (e.g., injection fluid) enters formation 18 through first fractures 22 (e.g., injection fractures) associated with the outflow zones of tubular 26, pressurizing the reservoir and displacing the reservoir fluid toward second fractures 24 (e.g., production fractures) associated with the inflow zones of the tubular. Fluid 60 can comprise a liquid, a gas, or a combination of both, and the composition of the fluid can change over the course of injection. Non-limiting examples of suitable gasses for fluid 60 include methane, other hydrocarbon gasses, nitrogen, carbon dioxide, and/or the like, which desirably are miscible, and non-limiting examples of suitable liquids for the fluid include water as well as any solutions, emulsions, suspensions, or mixtures that are used for water flooding. For at least some formations (e.g., 18), gas is preferred for use as the injection fluid (e.g., 60) due, in part, to its enhanced ability to enter the formation and its compressibility; to illustrate, in some methods, fluid 60 comprises a majority, by volume (determined at the pressure at which the fluid is injected, measured at the surface, into the formation) and/or mass, of a gas.

The injection process, as depicted in FIG. 3C can be performed (e.g., substantially continuously) for a period of time that is greater than or equal to any one of, or between any two of: 1 week, 2 weeks, 1 month, 3 months, 6 months, 1 year, 2 years, or 4 years. Pressurizing of formation 18 may end when, for example, an injection rate of fluid 60 into wellbore portion 52 falls below a target or threshold rate, a target amount of fluid has been injected, or the like. In some embodiments, first valves 30 disposed at one portion (e.g., 52) of wellbore 14 may continue injecting fluid 60 into formation 18 while other first valves (e.g., valves having a higher cracking pressure) disposed at another portion of the wellbore are closed.

Figure 3D:
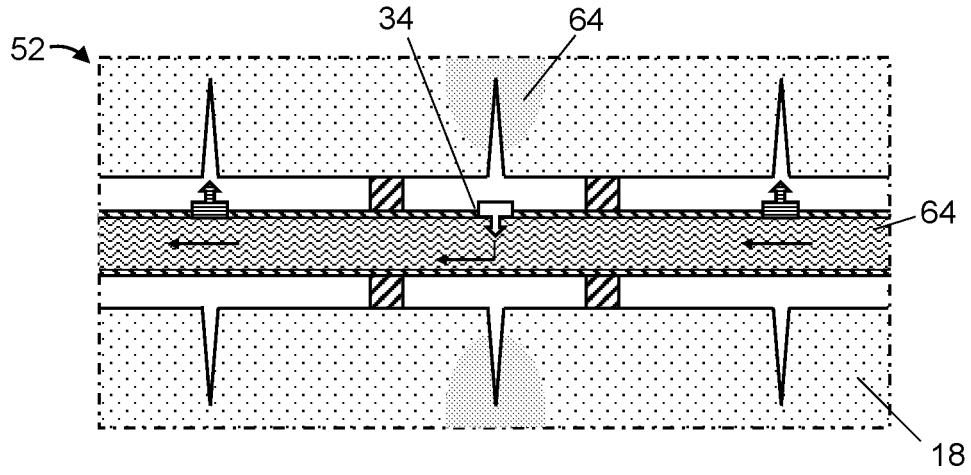
FIG. 3D is a schematic of the wellbore of FIG. 3A, shown during a production process.

Referring now to FIG. 3D, with formation 18 significantly more pressurized (e.g., via the injection process), fluid 64 (e.g., hydrocarbons, or a fluid mixture thereof) can then be produced from the formation via second fractures 24. Due, at least in part, to pressurization of formation 18, a pressure outside of tubular 26 in wellbore portion 52 can be increased. Additionally, as fluid 60 is no longer pumped into tubular 26, a pressure within passageway 28 can be reduced. As a result, the pressure inside tubular 26 is lower than outside the tubular, such that—responsive to the pressure differential—first valves 30 close and at least some of second valves 34 open. In some embodiments, one or more components (e.g., pumps) may be utilized to create a low pressure within passageway 28 to further increase the pressure differential.

The opening of second valves 34 releases fluid 64 that is held within formation 18 into passageway 28. As fluid 64 flows back through passageway 28, the fluid is directed to the well head (e.g., produced). Such production performed by system 10 results in greater hydrocarbon recovery as compared to that achievable through primary or other post-primary recovery methods.

The production process can be performed (e.g., substantially continuously) for a period of time that is greater than or equal to any one of, or between any two of: 1 week, 2 weeks, 1 month, 3 months, 6 months, 1 year, 2 years, or 4 years. Production from formation 18 may end when, for example, a production rate falls below a target or threshold rate, a target amount of fluid has been produced, or the like. In some embodiments, second valves 34 disposed at one portion (e.g., 52) of wellbore 14 may continue producing fluid 64 from formation 18 while other second valves (e.g., valves having a higher cracking pressure) disposed at another portion of the wellbore are closed.

Each injection and production cycle can last days, months, or years, depending on the reservoir properties, injection and production pressures, the fracture properties, and system settings. For system 10, the cycles can be conducted simply through changing the pressure within passageway 28 to fluctuate between injection and production operating modes.

System 10 can be employed in new or pre-existing wells to enable inter-fracture flooding via cyclic injection and production operations. In such operations, when a fluid (e.g., 60) is injected into the well, it can flow into fractures (e.g., 22) that are designated as injection fractures (e.g., only), thereby pressurizing the reservoir and pushing reservoir fluid (e.g., 64) toward production fractures (e.g., 22). When fluid (e.g., 64) is extracted from the well, valves (e.g., 30) associated with injection fractures are closed and valves (e.g., 34) associated with production fractures are open, and the fluid flows into the wellbore from the production fractures. Injection and production may be alternately conducted. Each injection or production step of a cycle may last days, months, or years. One or more cycles may be conducted.

Furthermore, the system may be installed in multiple wells that are on the same pad. Through synchronized operations among the wells, inter-well fracture communications may be mitigated for better recovery at individual wells. Through a controlled asynchronous operation, the recovery may be further enhanced by sweeping the reservoirs in between adjacent wells, especially if the fractures are generated in a controlled manner with predictable patterns.

EXAMPLES

The present invention will be described in greater detail by way of specific examples. The following examples are offered for illustrative purposes only and are not intended to limit the present invention in any manner. Those skilled in the art will readily recognize a variety of non-critical parameters that can be changed or modified to yield essentially the same results.

Figure 4A:
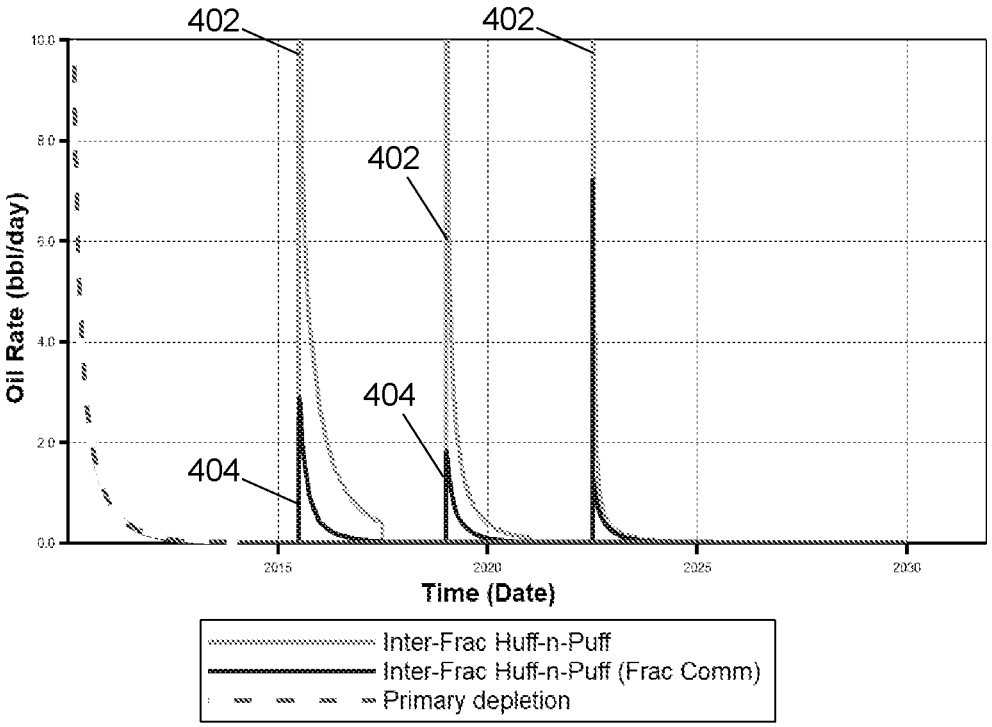
FIG. 4A illustrates simulations of the oil production rate achieved through use of one of the present systems over a 3-cycle operation after primary depletion of a reservoir section where: (1) injection and production fractures are isolated ("Inter-Frac Huff-n-Puff"); and (2) where injection and production fractures are in fluid communication ("Inter-Frac Huff-n-Puff (Frac Comm)").
Figure 4B:
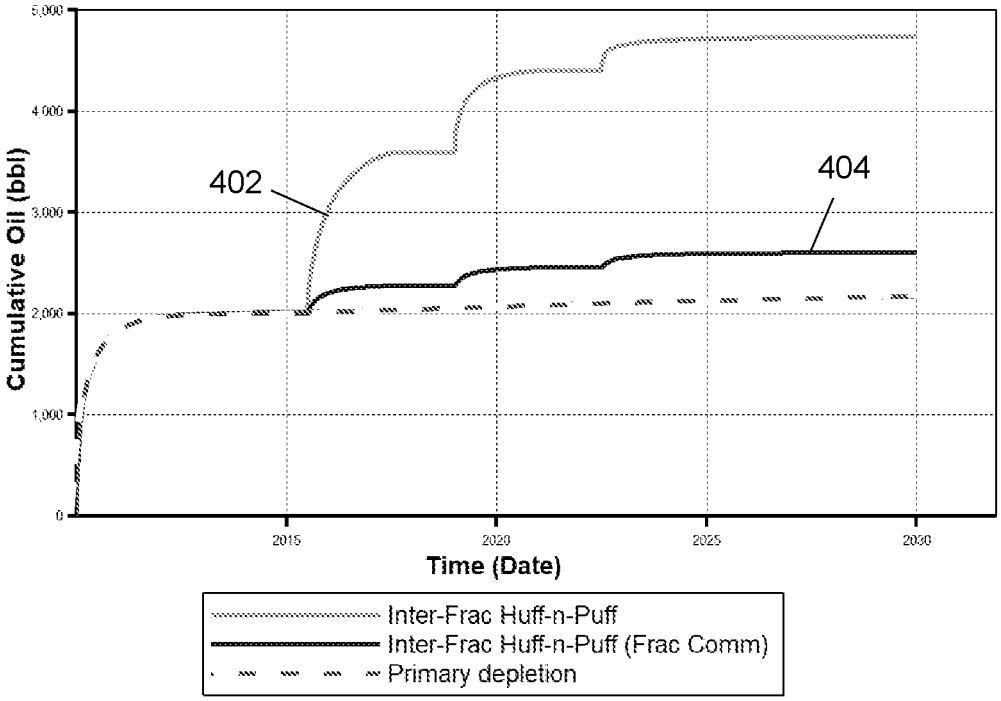
FIG. 4B illustrates the cumulative oil production of the simulations of FIG. 4A.

Computational analysis was performed to determine oil recovery in a horizontal well with hydraulic fractures spaced along the lateral at a spacing of approximately 60 feet, the hydraulic fractures being planar fractures. The analysis was performed using an average formation permeability of 0.0001 mD. FIGS. 4A and 4B indicate an example of operating the well using the present system. As best shown in FIG. 4B, the secondary recover process was installed after 4 years of primary depletion, which is illustrated by the dashed line. During the secondary recovery process, a miscible gas was injected into the formation for 18 months at an injection pressure approximately equal to the initial reservoir pressure. A production process was then implemented for 2 years, letting the well flow naturally before applying artificial lift, or directly applying artificial lift to the well. Two additional injection and production cycles of the same durations were calculated after the first recovery process.

The analysis was done for two different assumptions, a case where each of the injection and production fractures were isolated from one another (simulation 402), and a case where all of the injection and production fractures were in fluid communication with one another (simulation 404). As shown, the oil recovery was slightly higher for simulation 404 as compared to primary depletion (dashed line), while simulation 402 provided double the oil recovery from primary depletion. The results of simulation 404 were similar to that of typical, conventional huff-and-puff processes.

In practice, complete isolation of each injection and production fracture—as assumed for simulation 402—is improbable. Accordingly, an accurate practical simulation of the present system would lie somewhere in-between simulation 402 and simulation 404. With proper setup and operation, the present system should be able to almost double the oil production from primary depletion.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A system for inter-fracture flooding of a wellbore, the system comprising:

a tubular defining a passageway;

one or more packers coupled to the tubular; and one or more inflow unidirectional valves coupled to the tubular each configured to:

open to permit fluid communication from outside of the tubular to the passageway through the inflow unidirectional valve; and close to prevent fluid communication from the passageway to outside of the tubular through the inflow unidirectional valve;

wherein, for each of the inflow unidirectional valve(s), at least one of the packer(s) is disposed between the inflow unidirectional valve and a closest unidirectional valve that is configured to open to permit fluid communication from the passageway to outside of the tubular and close to prevent fluid communication from outside of the tubular to the passageway along the tubular.

2. The system of claim 1, wherein at least one of the unidirectional valves is configured to open in response to a pressure differential between the passageway and outside of the tubular that acts on the unidirectional valve.

3. The system of claim 2, wherein at least one of the closest unidirectional valve(s) is biased closed.

4. The system of claim 3, wherein at least one of the closest unidirectional valve(s) is configured to open when pressure in the passageway acting on the closest unidirectional valve is at least 1 pound per square inch (psi) higher than pressure outside of the tubular acting on the closest unidirectional valve.

5. The system of claim 2, wherein at least one of the inflow unidirectional valve(s) is biased closed.

6. The system of claim 5, wherein at least one of the inflow unidirectional valve(s) is configured to open when pressure outside of the tubular acting on the inflow unidirectional valve is at least 1 psi higher than pressure in the passageway acting on the inflow unidirectional valve.

7. The system of claim 1, wherein at least one of the unidirectional valves is a check valve.

8. The system of claim 1, wherein:

the packer(s) comprise two or more packers; and at least two of the packers are each disposed between adjacent ones of the unidirectional valves along the tubular.

9. The system of claim 1, wherein:

the packer(s) comprise two or more packers;

wherein the inflow unidirectional valve(s) comprise two or more inflow unidirectional valves, and at least two of the inflow unidirectional valves are disposed between adjacent ones of the packers along the tubular.

10. A method for inter-fracture flooding of a wellbore, the method comprising:

disposing a tubular having a passageway into the wellbore, the tubular coupled to one or more first valves and one or more second valves;

increasing pressure within the passageway such that, responsive to the increasing pressure, the first valve(s) open and fluid flows from the passageway, through the first valve(s), and into one or more first fractures of the wellbore; and reducing pressure within the passageway such that, responsive to the reducing pressure:

the first valve(s) close; and the second valve(s) open and hydrocarbons flow from one or more second fractures of the wellbore, through the second valve(s), and into the passageway, wherein one or more packers are coupled to the tubular; and wherein, for each of the second valve(s), at least one of the packer(s) is disposed between the second valve and a closest valve that opened to allow fluid flow into the first fracture(s) of the wellbore along the tubular during the increasing pressure within the passageway.

11. The method of claim 10, wherein:

the packer(s) comprise two or more packers; and at least two of the packers are each disposed between adjacent ones of the valves along the tubular.

12. The method of claim 10, wherein at least one of the valves is a unidirectional valve.

13. The method of claim 10, wherein at least one of the closest valve(s) is biased closed.

14. The method of claim 10, wherein at least one of the second valve(s) is biased closed.

15. The method of claim 10, wherein at least one of the valves is a check valve.

16. The method of claim 10, wherein increasing pressure within the passageway is performed at least by pumping fluid into the passageway.

17. The method of claim 16, wherein the pumped fluid comprises a majority, by volume and/or mass, of a gas.

18. The method of claim 10, wherein a formation into which the wellbore extends has an average permeability that is less than approximately 0.5 millidarcies (mD), optionally, less than approximately 0.1 mD.

19. The method of claim 10, wherein the wellbore is cased.

* * * * *